US010150540B2

(12) United States Patent
Lake et al.

(10) Patent No.: US 10,150,540 B2
(45) Date of Patent: Dec. 11, 2018

(54) APPARATUS FOR TOWING A WATER SPORTS PERFORMER

(71) Applicants: MasterCraft Boat Company, LLC, Vonore, TN (US); Gere Marie Corporation, Lake Zurich, IL (US)

(72) Inventors: Ryan D. Lake, Madisonville, TN (US); Darren S. Sheedy, Greenback, TN (US); James G. Schultz, Lake Zurich, IL (US)

(73) Assignees: MasterCraft Boat Company, LLC, Vonore, TN (US); Gere Marie Corporation, Lake Zurich, IL (US)

( * ) Notice: Subject to any disclaimer, the term of this patent is extended or adjusted under 35 U.S.C. 154(b) by 0 days.

(21) Appl. No.: 15/628,791

(22) Filed: Jun. 21, 2017

(65) Prior Publication Data

US 2017/0369134 A1 Dec. 28, 2017

Related U.S. Application Data

(60) Provisional application No. 62/355,079, filed on Jun. 27, 2016.

(51) Int. Cl.
*B63B 17/00* (2006.01)
*B63B 21/04* (2006.01)
(Continued)

(52) U.S. Cl.
CPC ..... *B63B 35/816* (2013.01); *B63B 17/02* (2013.01); *B63B 15/00* (2013.01); *B63B 17/00* (2013.01); *B63B 35/815* (2013.01)

(58) Field of Classification Search
CPC ..... B63B 15/00; B63B 2015/00; B63B 17/00; B63B 17/02; B63B 2017/00;
(Continued)

(56) References Cited

U.S. PATENT DOCUMENTS 5,052,326 A 10/1991 Wiggen et al.
5,673,507 A 10/1997 Stokes, Jr.
(Continued)

OTHER PUBLICATIONS

2015 MasterCraft NXT 20 for sale in Montgomery, Texas, OnlyInboards.com, https://www.onlyinboards.com/2015-MasterCraft-NXT-20-for-sale-Montgomery-Texas-63404.aspx (visited Nov. 20, 2017) (showing photos of a 2015 MasterCraft NXT 20 equipped with an NXT tower and bimini).
(Continued)

*Primary Examiner* — Daniel V Venne
(74) *Attorney, Agent, or Firm* — Fitzpatrick, Cella, Harper & Scinto

(57) ABSTRACT

An apparatus for towing a water sports performer including a first leg, a second leg, a header, and a tow-line-attachment structure. Each of the first leg and second leg is adapted for attachment to one of the port side of a centerline of a boat or the starboard side of a centerline of a boat. The header is capable of assuming a plurality of different header lengths, and includes a first header portion, a second header portion, a housing, and a locking mechanism. The housing connects the first header portion and the second header portion. The housing includes a first receiver configured to receive a second end of the first header portion at a plurality of different positions. The locking mechanism is configured to secure the second end of the first header portion to the housing in one of the plurality of different positions to set the header length.

20 Claims, 15 Drawing Sheets

(51) Int. Cl.

| | |
|---|---|
| ***B63B 21/56*** | (2006.01) |
| ***B63B 35/81*** | (2006.01) |
| ***B63B 17/02*** | (2006.01) |
| *B63B 15/00* | (2006.01) |

(58) Field of Classification Search
CPC . B63B 2017/02; B63B 35/815; B63B 35/816; B63B 2035/85
USPC ..... 114/242, 253, 364
See application file for complete search history.

(56) References Cited

U.S. PATENT DOCUMENTS

| | | | | |
|---|---|---|---|---|
| 6,044,788 | A | 4/2000 | Larson et al. | |
| 6,151,756 | A | 11/2000 | Czipri | |
| 6,192,819 | B1 | 2/2001 | Larson et al. | |
| 6,374,762 | B1 | 4/2002 | Larson et al. | |
| RE37,823 | E | 9/2002 | Larson et al. | |
| 6,539,886 | B2 * | 4/2003 | Henry | B63B 35/816 114/253 |
| 6,666,159 | B2 | 12/2003 | Larson et al. | |
| 6,792,888 | B1 | 9/2004 | Metcalf | |
| 6,834,607 | B1 * | 12/2004 | Johnson | B63B 35/815 114/242 |
| 6,854,413 | B2 | 2/2005 | Jackson et al. | |
| 6,865,999 | B2 | 3/2005 | Bierbower, Jr. | |
| 6,986,321 | B2 | 1/2006 | Metcalf | |
| 6,997,131 | B2 | 2/2006 | Jackson et al. | |
| 7,162,968 | B2 | 1/2007 | Thompson | |
| 7,219,617 | B2 | 5/2007 | Metcalf | |
| 7,234,408 | B1 * | 6/2007 | Clemmons | B63B 35/816 114/253 |
| 7,302,907 | B2 * | 12/2007 | Carlton | B63B 35/815 114/253 |
| 7,334,956 | B2 | 2/2008 | Taylor | |
| 7,392,758 | B2 | 7/2008 | Metcalf | |
| 7,536,971 | B1 | 5/2009 | Fry | |
| D605,575 | S * | 12/2009 | Oswell | D12/317 |
| 7,661,382 | B2 * | 2/2010 | Wood | B60N 2/203 114/363 |
| D611,397 | S * | 3/2010 | Oswell | D12/317 |
| 7,699,016 | B2 * | 4/2010 | Snook | B63B 15/00 114/253 |
| 8,166,905 | B2 | 5/2012 | Gratsch | |
| 8,171,874 | B2 | 5/2012 | Gasper | |
| 8,196,542 | B2 | 6/2012 | Oswell et al. | |
| 8,205,571 | B1 | 6/2012 | Rondeau et al. | |
| D664,495 | S * | 7/2012 | Oswell | D12/317 |
| 8,485,119 | B2 | 7/2013 | Gasper | |
| 8,495,967 | B2 | 7/2013 | Williams et al. | |
| 8,522,706 | B2 | 9/2013 | Larson et al. | |
| 8,555,802 | B2 | 10/2013 | Oswell et al. | |
| 9,061,748 | B2 | 6/2015 | Metcalf | |
| 9,114,854 | B2 | 8/2015 | Williams et al. | |
| 9,114,855 | B2 | 8/2015 | Nemeth | |
| D739,806 | S * | 9/2015 | Oswell | D12/317 |
| 9,180,943 | B2 * | 11/2015 | Oswell | B63B 35/816 |
| 9,315,237 | B2 * | 4/2016 | Snook | B63B 1/32 |
| 9,580,155 | B2 | 2/2017 | Lake et al. | |
| 9,926,045 | B1 | 3/2018 | Ostmeyer et al. | |
| 2013/0340664 | A1 | 12/2013 | Larson et al. | |
| 2014/0048007 | A1 | 2/2014 | Williams et al. | |
| 2014/0190392 | A1 | 7/2014 | Williams et al. | |

OTHER PUBLICATIONS

2015 MasterCraft NXT20 Ski Boats in Pleasanton, CA, U.S., BoatTEST.com, http://www.boattest.com/classifieds/Ads/Detail/1266274 (visited Nov. 20, 2017) (showing photos of a 2015 MasterCraft NXT 20 equipped with an NXT tower and bimini).

2015 MasterCraft X30 Black White, Utah Water Sports, https://www.utahwatersports.com/listings/2015-mastercraft-x30-black-white/ (visited Nov. 17, 2015) (showing photos of a 2015 MasterCraft X30 equipped with a ZFT4 tower and bimini).

MasterCraft X30 2013, CoasttoCoastBoats.com, http://coasttocoastboats.com/mastercraft-x30-2013/ (visited Nov. 20, 2017) (showing photos of a 2013 MasterCraft X30 equipped with a ZFT4 tower and bimini).

2016 MasterCraft Owner's Manual, pp. 1-3, 255-263, 272, and 273.

2015 MasterCraft Owner's Manual, pp. I to V, 4-38 to 4-44, 4-50, and 4-51.

2013 MasterCraft Owner's Manual, pp. i to ix, 3-18, 3-19, 5-11, and 5-12.

2012 MasterCraft Owner's Manual, pp. i to x, 2-66 and 4-6.

2011 MasterCraft Owner's Manual, pp. i to x, 6-10, 6-11, 14-3, and 14-4.

Komo Boat Bimini Top Towel Clip for Hanging/Drying Towels, Clothes (Multicolored), Amazon.com, https://www.amazon.com/Komo-Bimini-Hanging-Clothes-Multicolored/ (visited Jan. 14, 2016).

Round BiminiClip Towel Hanger, National Bimini Tops, http://www.nationalbiminitops.com/towel-hanger-biminiclip.html (visited Jan. 14, 2016).

Square BiminiClip Towel Hanger, National Bimini Tops, http://www.nationalbiminitops.com/square-bimini-clip.html (visited Jan. 14, 2016).

* cited by examiner

APPARATUS FOR TOWING A WATER SPORTS PERFORMER

CROSS-REFERENCE TO RELATED APPLICATION

This application claims the benefit under 35 U.S.C. § 119(e) of U.S. Provisional Patent Application No. 62/355,079, filed Jun. 27, 2016, and titled "Apparatus for Towing a Water Sports Performer." The foregoing application is hereby incorporated by reference in its entirety and is made a part of this specification for all that it discloses.

FIELD OF THE INVENTION

This invention relates to an apparatus for towing a water sports performer behind a boat.

BACKGROUND OF THE INVENTION

Boats are used to tow water sports performers, such as water skiers, wakeboarders, and the like, using a tow-line. The performer holds onto one end of the tow-line, and the other end is attached to the boat. For wakeboarding, the tow-line is typically attached to the top of a tower, which provides a higher tow-line-attachment point than a pylon provides. Boats, however, have different beam widths, which requires a unique tower design for each boat, or at least, unique components for each tower.

Bimini tops are useful to provide protection to the passengers of the boat from the elements, such as the sun and rain. When used on boats with a tower, the bimini top may be attached to the tower, but these bimini tops often have an add-on look-and-feel, detracting from the overall appearance of the boat and the tower.

SUMMARY OF THE INVENTION

In one aspect, the invention relates to an apparatus for towing a water sports performer. The towing apparatus includes a first leg, a second leg, a header, and a tow-line-attachment structure provided on the header. The first leg is adapted for attachment to one of the port side of a centerline of a boat or the starboard side of a centerline of a boat, and the second leg is adapted for attachment to the other one of the port side of a centerline of a boat or the starboard side of a centerline of a boat. The header is capable of assuming a plurality of different header lengths and includes a first header portion, a second header portion, a housing, and a first locking mechanism. The first header portion includes a first end connected to the first leg and a second end. The second header portion includes a first end connected to the second leg and a second end. The housing connects the first header portion and the second header portion. The housing includes a first receiver configured to receive the second end of the first header portion at a plurality of different positions. The first locking mechanism is configured to secure the second end of the first header portion to the housing in one of the plurality of different positions to set the header length.

In another aspect, the invention relates to an apparatus for towing a water sports performer. The towing apparatus includes a first leg, a second leg, a header, and a tow-line-attachment structure provided on the header. The first leg is adapted for attachment to one of the port side of a centerline of a boat or the starboard side of a centerline of a boat, and the second leg is adapted for attachment to the other one of the port side of a centerline of a boat or the starboard side of a centerline of a boat. The header is capable of assuming a plurality of header lengths. The header includes a first header portion, a second header portion, a housing, and a plurality of locking mechanisms. The first header portion comprises two tubes each including a first end and a second end. The first end of each tube of the first header portion is connected to the first leg. The second header portion comprises two tubes each including a first end and a second end. The first end of each tube of the second header portion is connected to the second leg. The housing connects the first header portion and the second header portion. The housing includes at least four receivers configured to accept the second end of each of the parallel tubes of the first and second header portions at a plurality of different positions. Each locking mechanism corresponds to each tube and is configured to secure the tubes to the housing in one of the plurality of different positions to set the header length.

These and other aspects of the invention will become apparent from the following disclosure.

DETAILED DESCRIPTION OF THE PREFERRED EMBODIMENTS

Figure 1:
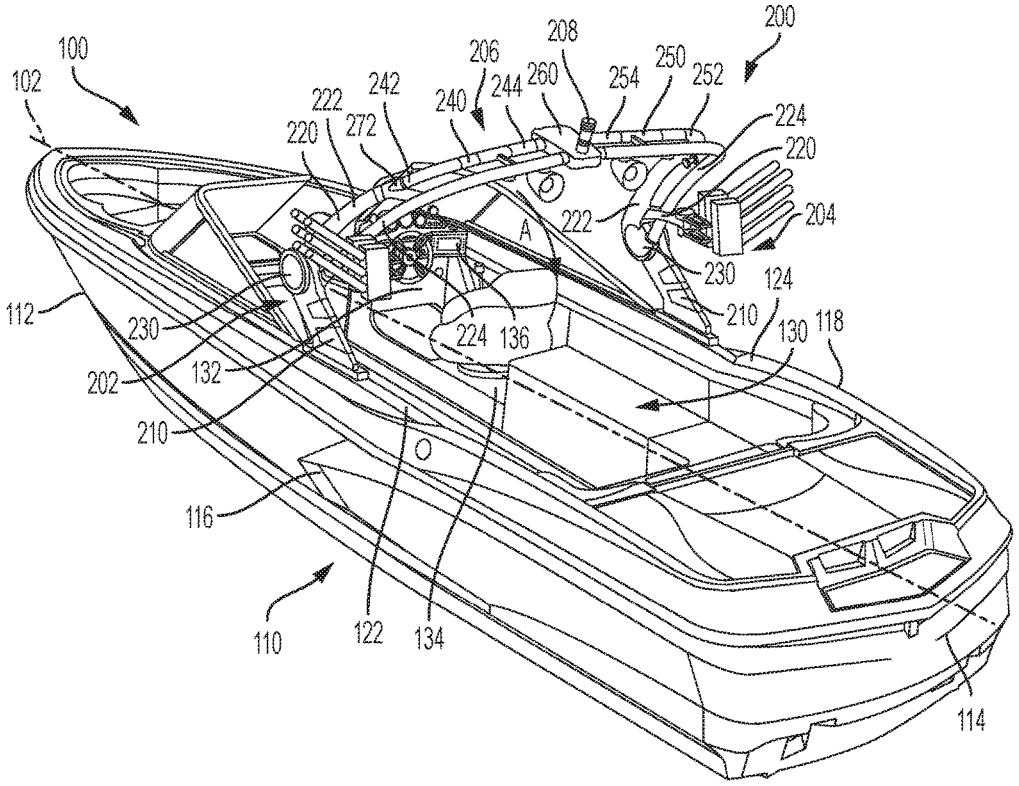
FIG. 1 shows a boat including an apparatus for towing a water sports performer according to a preferred embodiment of the invention.

FIG. 1 shows a boat 100 equipped with an apparatus 200 for towing a water sports performer in accordance with an exemplary preferred embodiment of the invention. The boat 100 includes a hull 110 with a bow 112, a transom 114, and port and starboard sides 116, 118. The port and starboard sides 116, 118 have port and starboard gunwales 122, 124, respectively. The boat 100 has a centerline 102 running down the middle of the boat 100, halfway between the port and starboard sides 116, 118. Within the boat's interior, 130 is a control console 132 for operating the boat 100.

The towing apparatus 200 includes two legs: a port leg 202 and a starboard leg 204. The port leg 202 is attached on the port side of centerline 102 of the boat 100, and the starboard leg 204 is attached on the starboard side of centerline 102 of the boat 100. Preferably, the port and starboard legs 202, 204 are attached to the port gunwale 122 and to the starboard gunwale 124, respectively. Alternatively, the legs 202, 204 may be attached to any suitable location on the port and starboard sides of centerline 102 of the boat 100, including for example, to the inboard or outboard of the sides 116, 118 of the hull 110 or to the floor 134 of the boat 100.

The towing apparatus 200 also includes a header 206. The header 206 is connected to an upper portion of each of the two legs 202, 204 and spans the interior 130 of the boat 100 at a height suitable for passengers to pass underneath while standing. In addition, the towing apparatus 200 has a tow-line-attachment structure 208 at an upper portion of the towing apparatus 200 (the header 206 in this embodiment). This tow-line-attachment structure 208 may be used to connect a tow-line suitable for towing a water sports performer, such as a wakeboarder. Any suitable tow-line-attachment structure may be used, including but not limited to the integrated light and tow-line-attachment assembly disclosed in U.S. Pat. No. 6,539,886, the disclosure of which is incorporated herein in its entirety.

Figure 2:
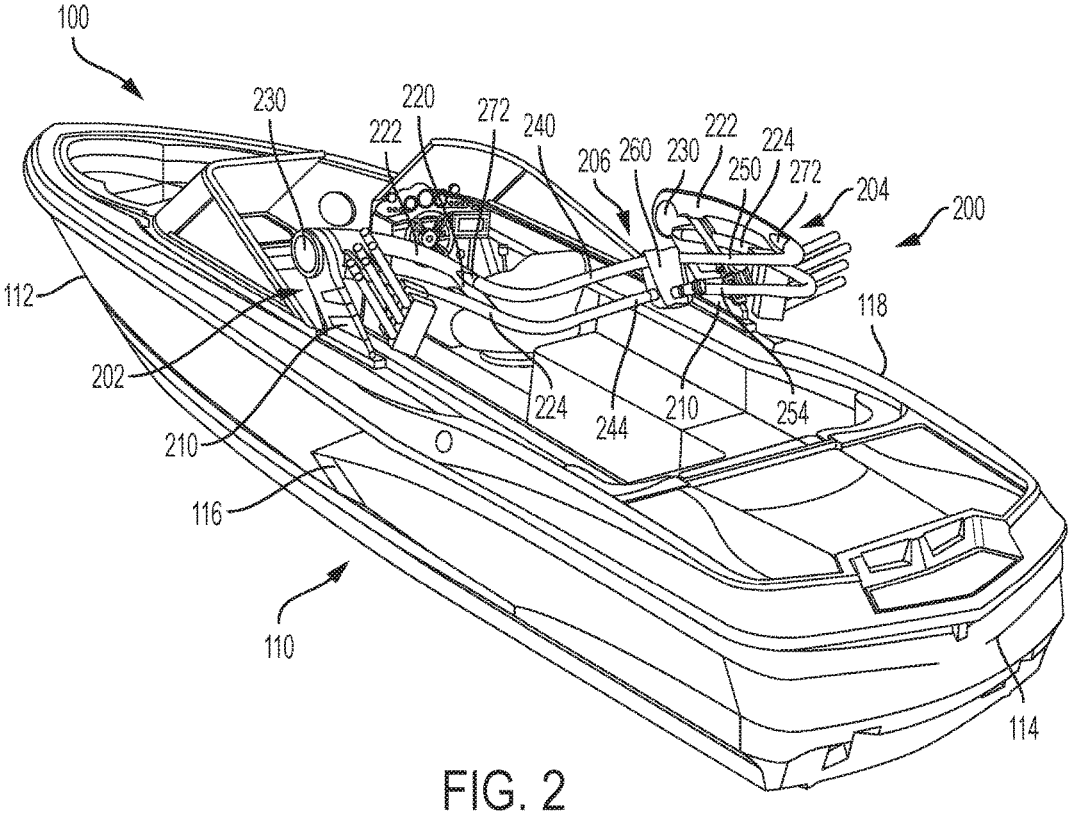
FIG. 2 shows the boat of FIG. 1 with the towing apparatus in a lowered position.

In this embodiment, port and starboard legs 202, 204 are mirror images of each other, but they may also have an asymmetric construction. Each leg 202, 204 comprises a lower leg 210 and upper leg 220. The lower leg 210 of each of the port and starboard legs 202, 204 is preferably attached to the respective gunwales 122, 124 using any suitable means including, for example, bolts. The lower leg 210 and the upper leg 220 are connected by a pivot 230. Because of its height, the towing apparatus 200 may interfere with transportation, storage, and the like when in an upright position as shown in FIG. 1. Therefore, in this embodiment, the towing apparatus 200 is rotatable down and aft in direction A to reduce the height of the towing apparatus 200. Instead of rotating down and aft, the towing apparatus 200 could be configured so that it rotates down and forward. FIG. 2 shows the towing apparatus 200 in the lowered position. The header 206 and upper leg 220 of each leg 202, 204 rotates in direction A about the pivot 230 to move from the upright position to the lowered position.

Figure 3:
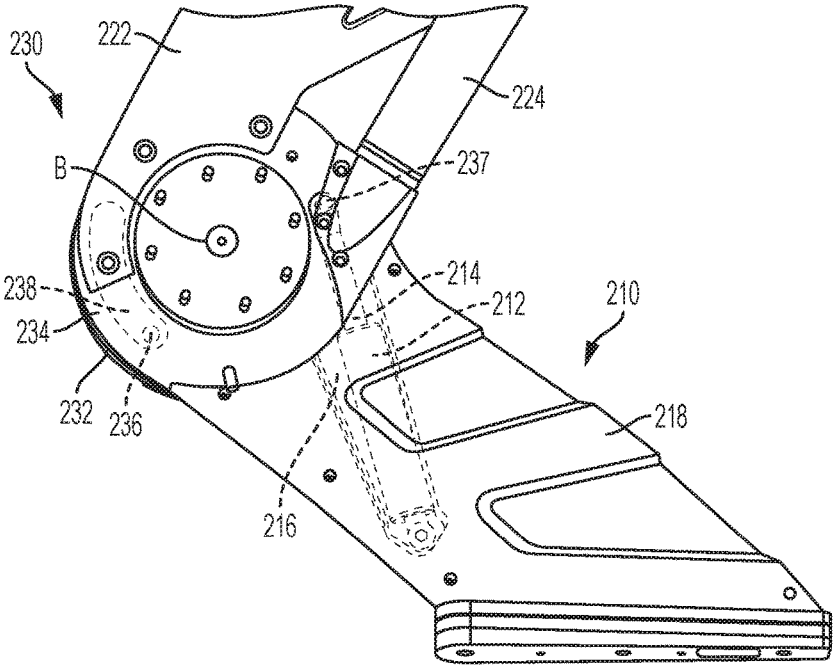
FIG. 3 is a detail view of the starboard leg of the towing apparatus shown in FIG. 1.
Figure 4:
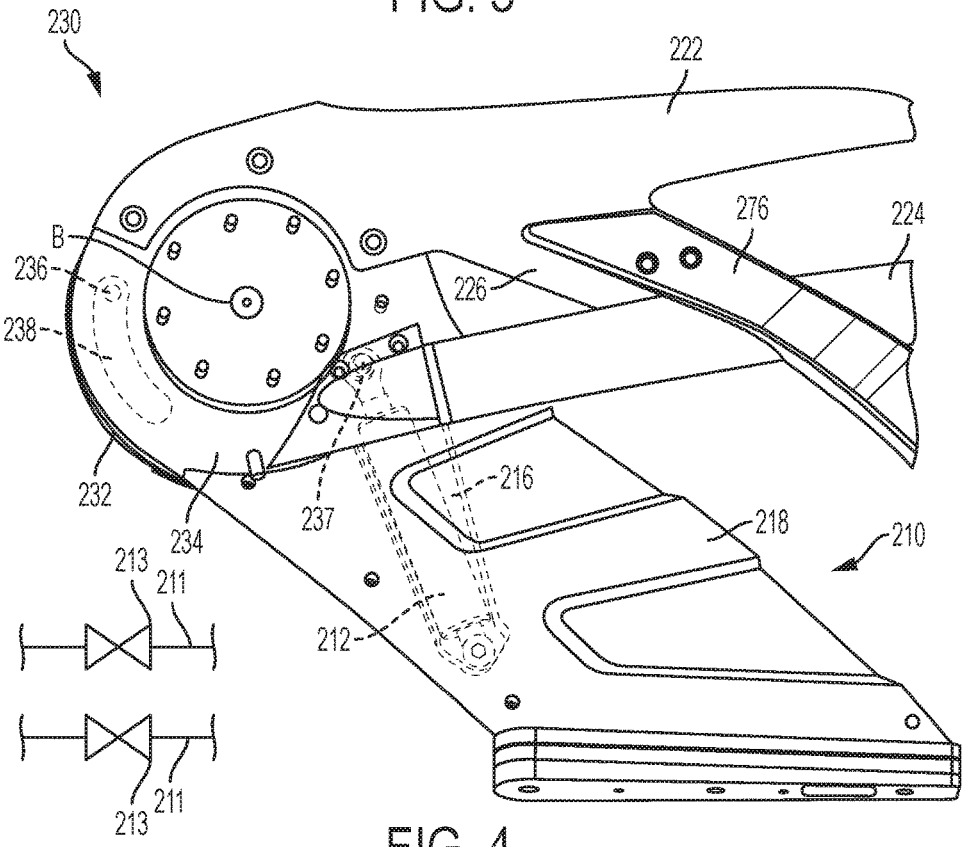
FIG. 4 is a detail view of the starboard leg shown in FIG. 3 in the lowered position.

FIGS. 3 and 4 are a detail views showing the lower leg 210, part of the upper leg 220, and the pivot 230 of the starboard leg 204. As discussed above, the port and starboard legs 202, 204 are mirror images; therefore, the following discussion is equally applicable to the port leg 202. FIG. 3 shows the towing apparatus 200 in the upright position, and FIG. 4 shows the towing apparatus 200 in the lowered position. The lower leg 210 is stationary and is connected to a stationary plate 232. The upper leg 220 is connected to a rotary plate 234. The stationary plate 232 and the rotary plate 234 are connected at their central axis B (see also FIGS. 15 and 16) by any suitable means, including for example, a bushing or a bearing, which allows the rotary plate 234 to rotate with respect to the stationary plate 232. The rotary plate 234 includes at least one pin 236, and the stationary plate 232 includes at least one of slot 238. The pin 236 slides within the corresponding slot 238. In this embodiment, the slot 238 is an arc having a radius from the central axis B. When the towing apparatus 200 is in its upright position, the pin 236 is at one end of its slot 238, and when the towing apparatus 200 is in its lowered position, the pin 236 is at the other end of its slot 238. The pin 236 and slot 238 thus limit the rotation of the upper legs 220 and the header 206, as they rotate between the upright position and the lowered position about the central axis B of the pivot 230.

The towing apparatus 200 may be rotated by any suitable means including, for example, a linear actuator. Although any suitable linear actuator may be used, including for example an electrical linear actuator, the linear actuator in this embodiment is a hydraulic cylinder 212 that has a ram 214 connected to the rotary plate 234 by any suitable means including, for example, a fastener such as a bolt 237. The hydraulic cylinder 212 is enclosed within a cavity 216 of the lower leg 210. The towing apparatus 200 may be raised from the lowered position to the upright position by extending the ram 214 and moved from the upright position to the lowered position by retracting the ram 214. The hydraulic cylinder 212 may raise and lower the towing apparatus 200 using other suitable configurations, including for example, connecting the ram 214 to the pin 236 forward of central axis B. In this alternative configuration, retracting the ram 214 would raise the towing apparatus 200 and extending the ram 214 would lower the towing apparatus 200.

The linear actuator may be operated by an input device 136. The input device 136 may be preferably located at the control console 132 (see FIG. 1) in order to receive inputs from the operator; such an input device 136 may include a switch or a touch screen, for example. The input device may provide inputs directly to the linear actuator or, in the case of the hydraulic system, the hydraulic pump moving the hydraulic fluid. Alternatively, the input device may provide inputs to a controller, which in turn controls the linear actuator. The controller may be any suitable controller including a microprocessor-based controller that has a processor and a memory. Sequences of instruction, e.g., software, may be stored on the memory and programmed to control the linear actuator as well as be responsive to the input device.

The linear actuator may be used to hold the towing apparatus 200 in its upright position. Alternatively, a locking mechanism (not shown) may be used. A mechanical lock may be used, for example, and when the ram 214 reaches the upright position, it activates the mechanical lock. When the linear actuator is a hydraulic cylinder 212, a hydraulic lockout system may be used, such as placing valves 213 in the supply lines 211 leading to the hydraulic cylinder 212 (see FIG. 4). These lockout valves are preferably placed close to the hydraulic cylinder 212. The lockout valves may be closed to isolate the cylinder 212 from the rest of the system, which maintains pressure in the cylinder and keeps the towing apparatus 200 in the upright position. When the controller is used, the controller may be programmed to operate the lockout system and lockout valves.

Another suitable means for rotating the towing apparatus 200 is manual rotation by a user. When the towing apparatus 200 is configured for manual rotation, a gas-assist shock is preferably used instead of the hydraulic cylinder 212. The gas-assist shock is located within the cavity 216 of the lower leg 210 where the hydraulic cylinder 212 is located and attached in the same manner as the hydraulic cylinder 212. The gas-assist shock is preferably oriented to maximize the vertical ("z") component of force from the shock, and this force is preferably selected to provide sufficient upward force on the upper legs 220 and header 206 to balance the downward rotation force imparted by the weight of these components. In this way, the towing apparatus 200 can be rotated in either direction with minimal effort by the user. When the towing apparatus 200 is manually rotated, a locking mechanism (not shown) is preferably used to lock the towing apparatus 200 in the upright and lowered positions.

As discussed above, the header 206 spans the interior 130 of the boat 100, as can been seen in FIG. 1. To enable a single design of the towing apparatus 200 to be used with different boats having different beam widths, (e.g., common parts used across multiple boat models) the header 206 can assume a plurality of different header lengths. In this embodiment, the header 206 has a first header portion 240 and a second header portion 250 that are connected by a housing 260, and each header portion 240, 250 has a first end 242, 252 and a second end 244, 254. The first end 242 of the first header portion 240 is connected to the upper leg 220 of the port leg 202, and the second end 244 of the first header portion 240 is connected to the housing 260. Likewise, the first end 252 of the second header portion 250 is connected to the upper leg 220 of the starboard leg 204, and the second end 254 of the second header portion 250 is connected to the housing 260. Each header portion 240, 250 may be connected to their respective upper legs 220 using any suitable means, including welding, fasteners, and the like. In addition, each header portion 240, 250 (or at least a part of each header portion 240, 250) may be connected to the upper leg 220 by being integrally formed with the upper leg 220. For example, when aluminum tubing is used for both the upper leg 220 and each of the header portions 240, 250, the upper leg 220 and the header portion 240, 250 may be formed by bending a piece of aluminum tubing.

The first header portion 240 and the second header portion 250 can be spaced different distances apart to create different header lengths. In this embodiment, the first and second header portions 240, 250 are mirror images of each other, but they may also have an asymmetric construction. Each header portion 240, 250 comprises two parallel aluminum tubes. Any suitable geometry and material may be used, however, to construct the first and second header portions 240, 250, for example, a single tube may be used instead of two parallel tubes.

Figure 5:
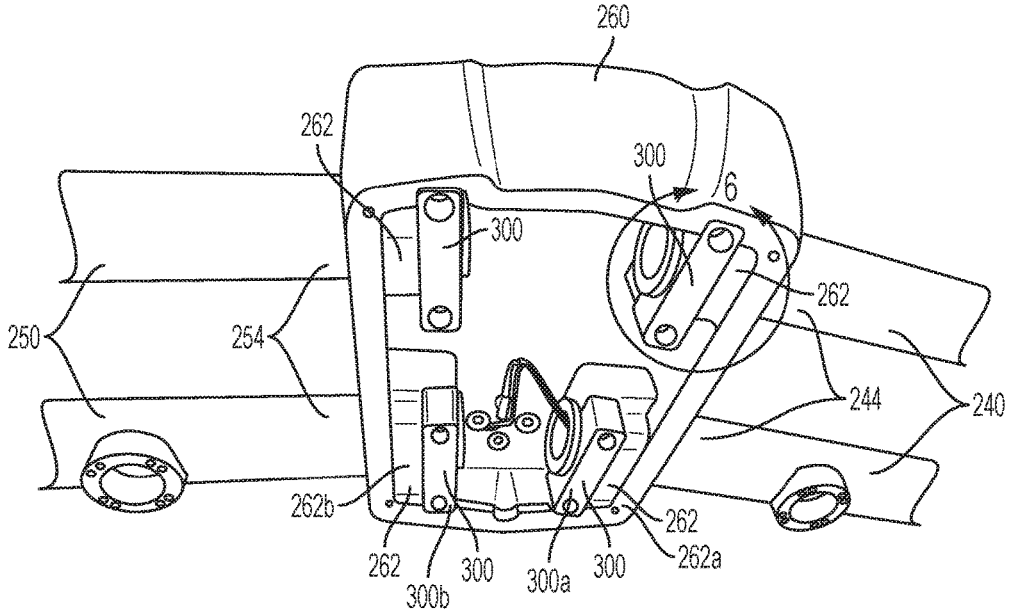
FIG. 5 is a detail view of a housing of a header for the towing apparatus shown in FIG. 1.

The second end 244, 254 of at least one header portion 240, 250 is adjustably engageable with the housing 260. The housing 260 includes at least one receiver 262 that receives the second end 244, 254 of at least one header portion 240, 250. The receivers 262 discussed herein are examples of preferred embodiments of a first receiver 262*a* and a second receiver 262*b*. FIG. 5 is a bottom detail view of the header 206 showing the housing 260 with a bottom plate (not shown) removed for illustration purposes. In this embodiment, the housing 260 is a hollow casting of aluminum having a generally rectangular cuboid shape. The housing 260, however, may be any suitable material and geometry and made by any suitable technique, including forging for example. The housing 260 has one side that faces the first header portion 240 and another side that faces the second header portion 250. Two receivers 262 are formed in each side. In this embodiment, the receivers 262 include a boss 264 formed on the interior of the housing 260 and a hole 266 formed in the housing 260 and extending through the center of the boss 264. The hole 266 is sized so that the second end 244, 254 is able to slide into the hole 266. The length of the header 206 is set by the distance that the second end 244, 254 extends into the hole 266. Moving the second end 244, 254 further into the hole 266 will shorten the header 206, and moving the second end 244, 254 out of the hole 266 will lengthen it. In this embodiment, the total length is set by positioning the second end 244, 254 of each header portion 240, 250 in the receiver 262. Once the length (width) of the header 206 is set for the boat 100, the second end 244, 254 (and thus the first and second header portions 240, 250) is secured by a locking mechanism 300. The locking mechanisms 300 discussed herein are examples of preferred embodiments of a first locking mechanism 300*a* and a second locking mechanism 300*b*. The boss 264 is preferably long enough that, when the header 206 is at its widest, none of the features of the locking mechanism 300, such as grooves 246 or holes 362 (discussed further below), are visible outside of the housing 260.

Figure 6:
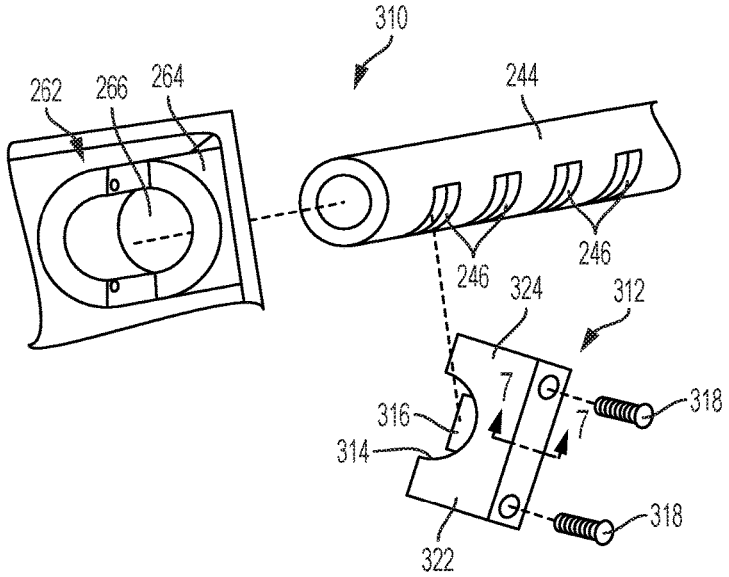
FIG. 6 is an exploded detail view of a locking mechanism for the housing shown in FIG. 5.

A more detailed description of the second end 244 of the first header portion 240, one of the receivers 262, and one of the locking mechanisms 300 will now be given. This description, however, applies equally to the second end 254 of the second header portion 250 and the other three receivers 262 and locking mechanisms 300 of the preferred embodiment. An exploded view of a preferred embodiment of the locking mechanism 310 is shown in FIG. 6. In this embodiment, the second end 244 includes a plurality of grooves 246 formed on the underside of the second end 244. The grooves 246 may have any suitable geometry including a geometry that extends around the entire circumference of the second end 244. Each of the plurality of grooves 246 corresponds to a different position of the header portion 240. The locking mechanism 310 also includes a clasp 312. The clasp 312 is in the shape of a rectangular block having a cutout 314 that corresponds to the geometry of the second end 244. In this embodiment, the cutout 314 is an arch that corresponds to the outer circumference of the second end 244, allowing the clasp 312 to slide around the second end 244. The clasp 312 also includes a tongue 316 located in the cutout 314 and configured to engage with each one of the plurality of grooves 246 in the second end 244. The header length may be set by sliding the second end 244 into the receiver 262 and then positioning the clasp 312 around the second end 244 to engage the tongue 316 with the groove 246 corresponding to the desired header length.

Figure 7A:
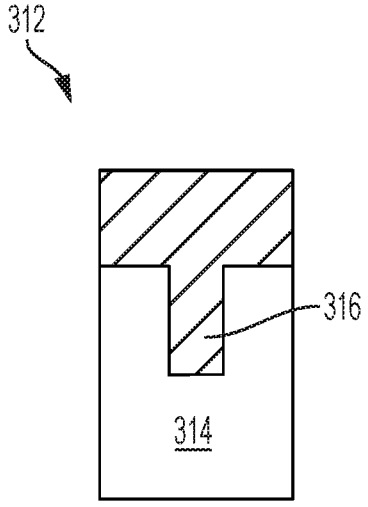
FIG. 7A is a cross-sectional view of a preferred embodiment of a clasp shown in FIG. 6 taken along section line 7-7 in FIG. 6.
Figure 7B:
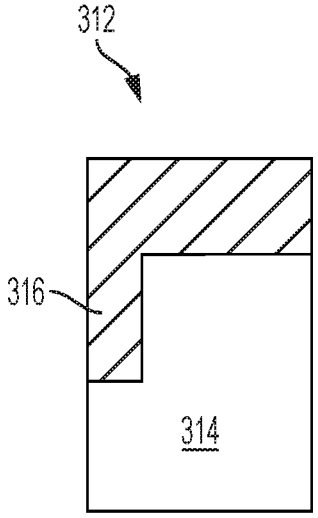
FIG. 7B is a cross-sectional view of another preferred embodiment of a clasp shown in FIG. 6 taken along section line 7-7 in FIG. 6.

FIGS. 7A and 7B show preferred embodiments of the clasp 312 taken along section line 7-7 in FIG. 6. In the embodiment shown in FIG. 7A, the tongue 316 is located in the center of the clasp 312.

In the embodiment shown in FIG. 7B, the tongue 316 is offset from the center of the clasp 312. The tongue 316 of this embodiment is positioned between two sides of the clasp 312 but closer to one side than the other. Preferably, the tongue 316 is located near one of the side edges of the clasp 312, and more preferably along one of the edges. Using the clasp 312 shown in FIG. 7B, a single groove 246 can be used for to two different positions of the header portion 240. For example, the clasp 312 may be positioned around the second end 244 with the tongue 316 outboard so that the side of the clasp 312 with the tongue 316 is placed closer to the boss 264 than the side without the tongue 316. With the clasp 312 in this orientation, the header portion 240 is in one position (a first position in this example) with the tongue 316 engaged with one of the grooves 246 (groove G in this example). However, the orientation of the clasp 312 may also be reversed. In the reverse orientation, the clasp 312 is positioned with the tongue 316 inboard so that the side of the clasp 312 without the tongue 316 is placed closer to the boss 264 than the side with the tongue 316. In the reverse orientation and with the tongue 316 is engaged with groove G, the header portion 240 is in a second position where the corresponding leg 202 is closer to the header 260 than it is in the first position.

In the embodiment shown in FIG. 6, the second end 244 is compressed between the clasp 312 and the boss 264. The boss 264 has a cutout to accommodate the clasp 312, and the clasp 312 is secured to the housing 260 using any suitable means, including for example bolts 318 that engage with threads tapped into the cutout of the boss 264. The clasp 312 of this embodiment has two end segments through which the bolts 318 are inserted: a first segment 322 and a second segment 324. Tightening the bolts 318 will pull their respective segments 322, 324, and thus the clasp 312, against the second end 244 and apply a compressive force to the second end 244. When both segments 322, 324 have equal lengths, the bolts 318 are preferably incrementally tightened by making small rotations of each bolt 318 and going back and forth between the segments 322, 324 to avoid the clasp 312 tilting during installation. Instead of the first and second segments 322, 324 being equal length, the first segment 322 may be longer than the second 324. With this construction, the bolt 318 in the first segment 322 may be completely tightened and then the bolt 318 in the second segment 324 may be tightened to apply the compressive force.

Figure 8A:
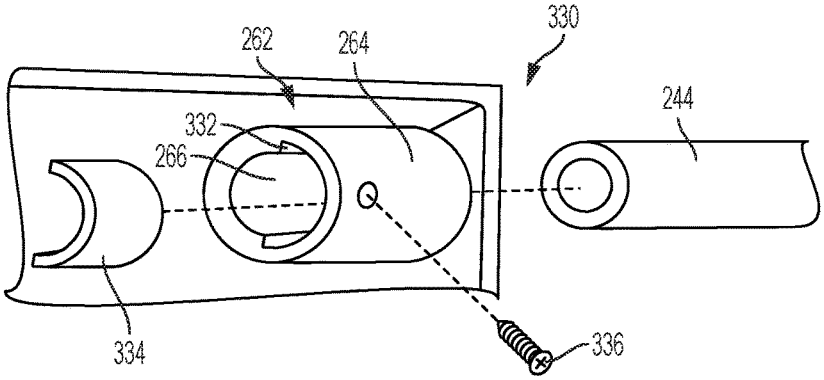
FIG. 8A is an exploded detail view of a first alternative locking mechanism for the housing shown in FIG. 5.
Figure 8B:
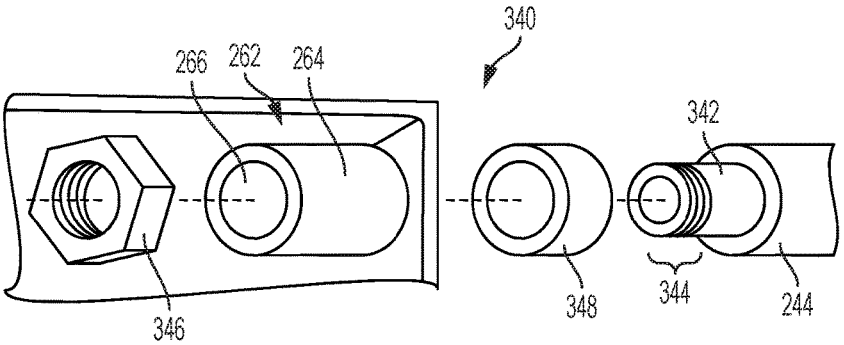
FIG. 8B is an exploded detail view of a second alternative locking mechanism for the housing shown in FIG. 5.
Figure 8C:
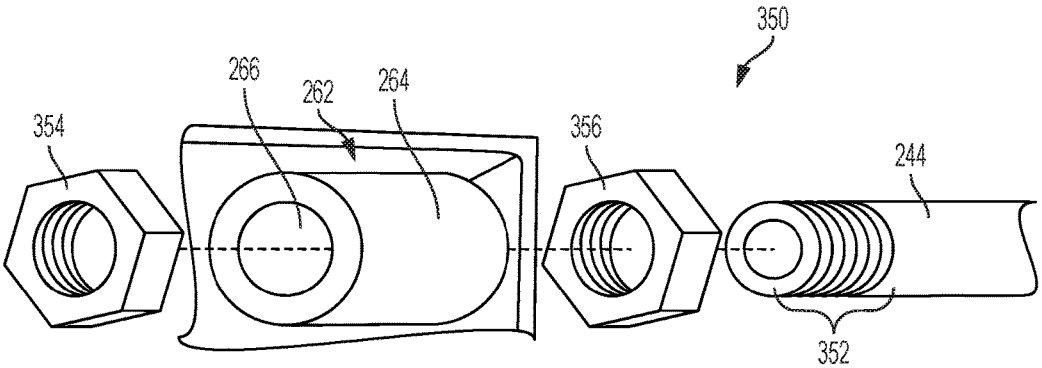
FIG. 8C is an exploded detail view of a third alternative locking mechanism for the housing shown in FIG. 5.
Figure 8D:
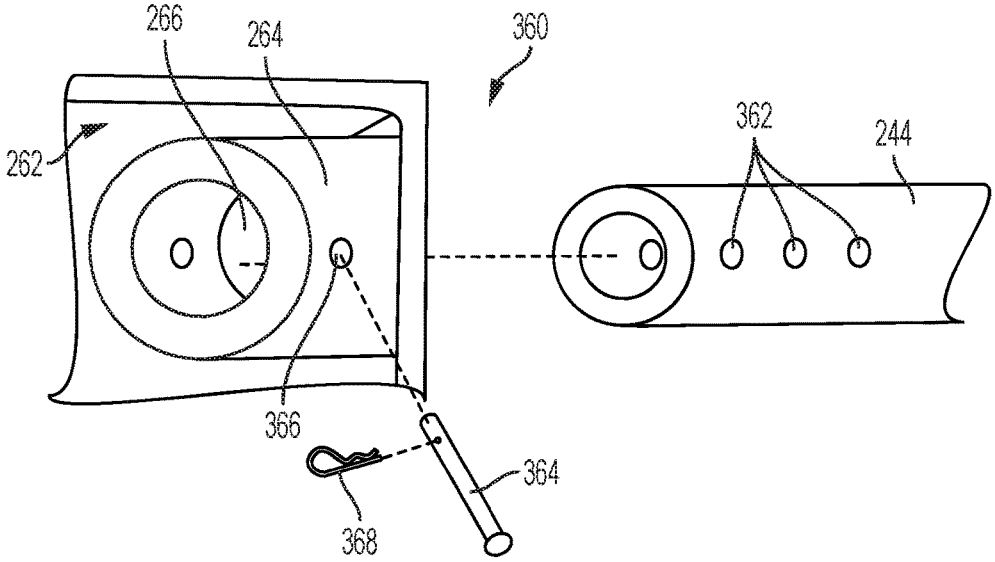
FIG. 8D is an exploded detail view of a fourth alternative locking mechanism for the housing shown in FIG. 5.
Figure 8E:
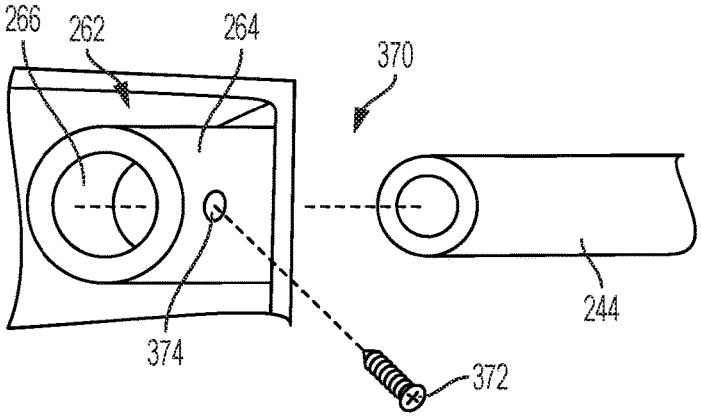
FIG. 8E is an exploded detail view of a fifth alternative locking mechanism for the housing shown in FIG. 5.

Any suitable locking mechanism 300 may be used, such as, for example, a first alternative locking mechanism 330 shown in FIG. 8A, a second alternative locking mechanism 340 shown in FIG. 8B, a third alternative locking mechanism 350 shown in FIG. 8C, a fourth alternative locking mechanism 360 shown in FIG. 8D, or a fifth alternative locking mechanism shown in FIG. 8E. The first alternative locking mechanism 330 shown in FIG. 8A is a clamp, in particular, a friction clamp. The boss 264 includes a cutout 332 around the hole 266. The cutout 332 is sized to accommodate a plate 334 corresponding to the geometry of the second end 244 with sufficient tolerance to allow the plate 334 to move. In this embodiment, the plate 334 is arc-shaped and has a shape that corresponds to the outer circumference of the second end 244. The header length may be set by sliding the second end 244 into the receiver 262 and then positioning the first and/or second header portions 240, 250 to the desired length. The second end 244 is compressed between the plate 334 and the boss 264, and held in place by applying a clamping force applied to the arc-shaped plate 334. In this embodiment, the clamping force is provided by a setscrew 336 that is used to press the plate 324 against the second end 244.

The locking mechanism 300 may also include a threaded connection such as the second alternative locking mechanism 340 shown in FIG. 8B. In this embodiment, the second end 244 has a portion (a stepped down portion 342) with a smaller geometry than the overall geometry of the second end 244. When the second end 244 has a cylindrical geometry, the stepped down portion 342 may have a smaller diameter than the second end 244. Male threads 344 are formed on the stepped down portion 342 of the second end 244. The stepped down portion 342 is inserted through the hole 266 of the boss 264, and a nut 346 is threaded onto the male threads 332 of the stepped down portion 342. By tightening the nut 346, the second end 244 is compressed against the housing 260 to securely fasten the header portion 240. To change the position of the header portion 240, a spacer may be used 348. The stepped down portion 342 is sized to accommodate a spacer 348 placed on the stepped down portion 342. Different size spacers 348 may be used to establish different positions of the header portion 240. With a spacer 348 installed, the second end 244 is compressed against the spacer 348, which in turn is compressed against the housing 260. The header length is set thus set by the selection of spacer 348 to position the first and/or second header portions 240, 250 to the desired length.

The third alternative locking mechanism 350 shown in FIG. 8C also uses a threaded connection and is similar to the second alternative locking mechanism 340. In this embodiment, male threads 352 are formed on the second end 244 and a first nut 354 is used to secure the header portion 240 in place. Instead of compressing the second end 244 against the housing 260, however, a second nut 356 is threaded onto the male threads 352 before the second end is slid into the receiver 262. The header length may be set by sliding the second end 244 into the receiver 262 and positioning the first and/or second header portions 240, 250 to the desired length. Then the first and second nuts 354, 356 are tightened against the boss 264 and the side of the housing 260, respectively, to secure the header portion 240 into place.

Another exemplary locking mechanism 300 (fourth alternative locking mechanism 360) is shown in FIG. 8D. In this embodiment, the second end 244 includes a plurality of holes 362 that extend through the diameter of the second end 244. Each of the plurality of holes 362 corresponds to a different position of the header portion 240. The locking mechanism 360 includes a pin 364 that is configured to slide into the holes 362 through the second end 244. The pin 364 is also configured to slide into a pin hole 366 formed through the diameter of the boss 264. The header length may be set by sliding the second end 244 into the receiver 262 to a position that aligns the hole 362 in the second end 244, which corresponds to the desired header length, with the pin hole 366 formed in the boss 264. The pin 364 is then engaged with the aligned holes 364, 366, to prevent the second end 244 from sliding out of the receiver 262. In this embodiment, the pin 364 is retained in the second end 244 and boss 264 by the head of the pin 364 and a securing pin 368, such as a hitch pin clip, that engages with the end of the pin 364 opposite the head. Other suitable retaining mechanisms may be used including, for example, the pin 364 being a bolt that engages with a nut or threads formed in the boss 264.

A fifth alternative locking mechanism 370 is shown in FIG. 8E. The header length may be set by sliding the second end 244 into the receiver 262 and then positioning the first and/or second header portions 240, 250 to the desired length. In this embodiment, a self-tapping screw 372 is inserted through a hole 374 formed in the boss 264. The self-tapping screw 372 is then rotated to form threads in the second end 244 and secure it in place.

The towing apparatus 200 also provides a suitable location on which to mount a bimini top 400 to protect the occupants of the boat 100 from the elements. The bimini top 400, which may also be referred to as a bimini cover, is moveable between a stowed position and a deployed position. The bimini top 400 is shown in the deployed position in FIG. 9 and in the stowed position in FIG. 11. The bimini top 400 includes a cover 402 that is supported by a frame 410 and the towing apparatus 200. In this embodiment, the cover 402 is a weather-proof or weather-resistant canvas, which can be rolled or folded to fill a compact volume in the stowed position. The bimini top 400 without the cover 402 is shown in the deployed position in FIG. 10.

The frame 410 is mounted to the towing apparatus 200 and constructed to have an integral look-and-feel, instead of the look of a separate, add-on construction, as is typically the case. In this embodiment, the frame 410 is constructed to complement the upper legs 220 of the port and starboard legs 202, 204. The upper legs 220 include a forward upper leg portion 222 and an aft upper leg portion 224. The aft upper leg portion 224 is an aluminum tube that, in the upright position, extends upward and aft from the pivot 320 and connects to the aft aluminum tube of either the first or second header portion 240, 250.

The forward upper leg portion 222 of the port leg 202 is machined from a piece of aluminum billet to have a first profile when viewed from the side. Likewise, the forward upper leg portion 222 of the starboard leg 204 is machined from a piece of aluminum billet to have a second profile when viewed from the side. In this embodiment, the first profile and the second profile are mirror images of each other, but they may also be different profiles. As with the aft upper leg portion 224, the forward upper leg portion 222 extends, in the upright position, upward and aft from the pivot 230 and connects, using an upper tube receiver 272, to the forward aluminum tube of either the first or second header portion 240, 250. In this embodiment, instead of being straight, the first and second profiles of the forward upper leg portions 222 include a sweeping curve at both the forward and aft edge. However, any suitable first and second profile may be used.

Figure 12:
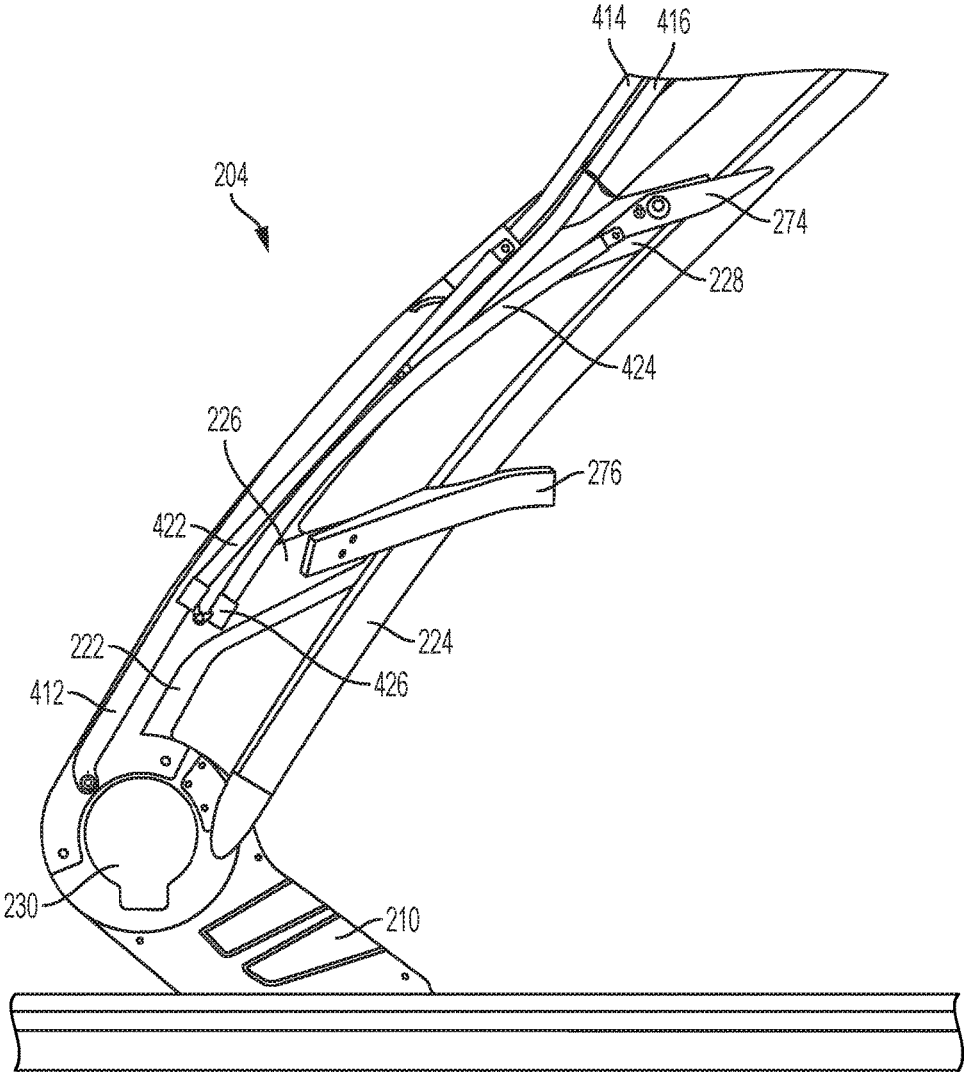
FIG. 12 is a perspective view of the inboard side of the starboard leg of the towing apparatus shown in FIG. 10 with the frame of the bimini top in the stowed position.
Figure 13:
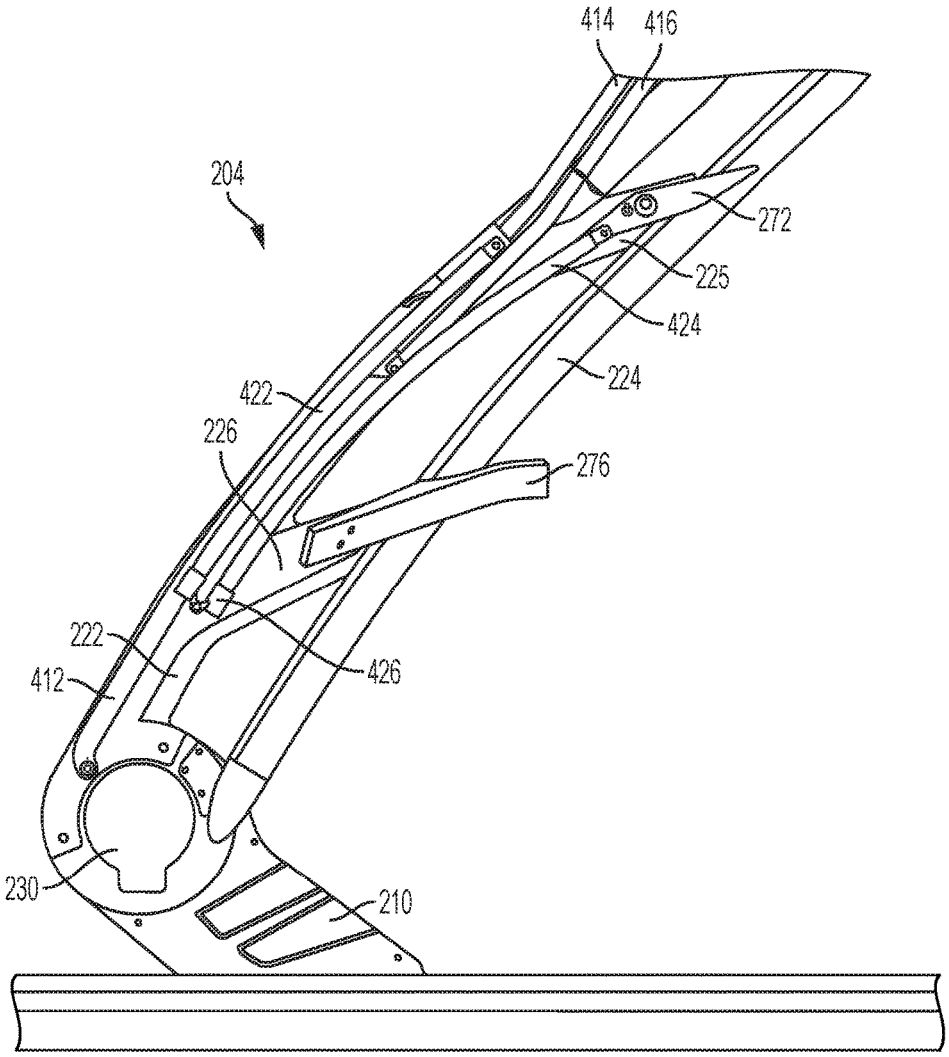
FIG. 13 shows an alternate frame of the bimini top in the stowed position from the perspective shown in FIG. 12.

The forward upper leg portion 222 is detachably connected to the upper tube receiver 272 using fasteners, and as can be seen in FIGS. 3 and 4, the forward upper leg portion 222 is detectably connected to the pivot 230 using fasteners. Any suitable fastener may be used including bolts. The forward upper leg portion 222 and aft upper leg portion 224 are connected by a pair of bow ties: an upper bow tie 274 and a lower bow tie 276. (The bow ties 274, 276 are best seen in FIGS. 12 and 13.) Each bow tie 274, 276 is welded to the inboard side of the aft upper leg portion 224 and extend forward. The forward upper leg portion 222 has a pair of protrusions 226, 228 that follow the profile of the bow ties 274, 276 and can be placed on the outboard side of the bow ties 274, 276 forward of the aft upper leg portion 224. Fasteners, such as bolts, for example, can be inserted on the inboard side of the bow tie 274, 276 into threads formed on the inboard side of the protrusions 226, 228. In this way, the forward upper leg portion 222 is detachably connected to the aft upper leg portion 224 without any welds used for this connection being visible when viewing the upper leg 220 from outside the boat 100.

The towing apparatus 200 may incorporate color, as opposed to the typical metallic color of the underlying material. When the towing apparatus 200 is constructed from aluminum, for example, the various aluminum pieces may be constructed from dyed and anodized aluminum. The forward upper leg portion 222 and an insert 218 of the lower leg 210 may be dyed the same color. The fastener attachment of the forward upper leg portion 222, described above, facilitates the used of dyed, anodized aluminum and allows one forward upper leg portion 222 to be swapped out for another if, for example, the forward upper leg portion is damaged or a user desires a different color.

Figure 10:
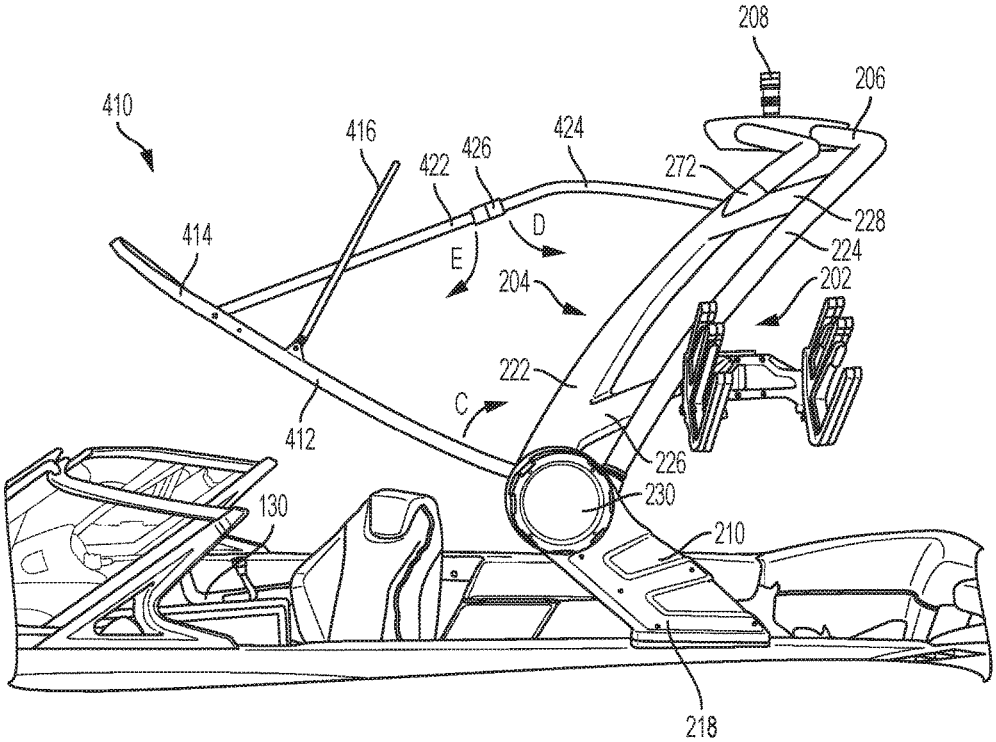
FIG. 10 is a perspective view of the towing apparatus shown in FIG. 9 showing the frame of the bimini top with the cover removed for the sake of illustration.
Figure 11:
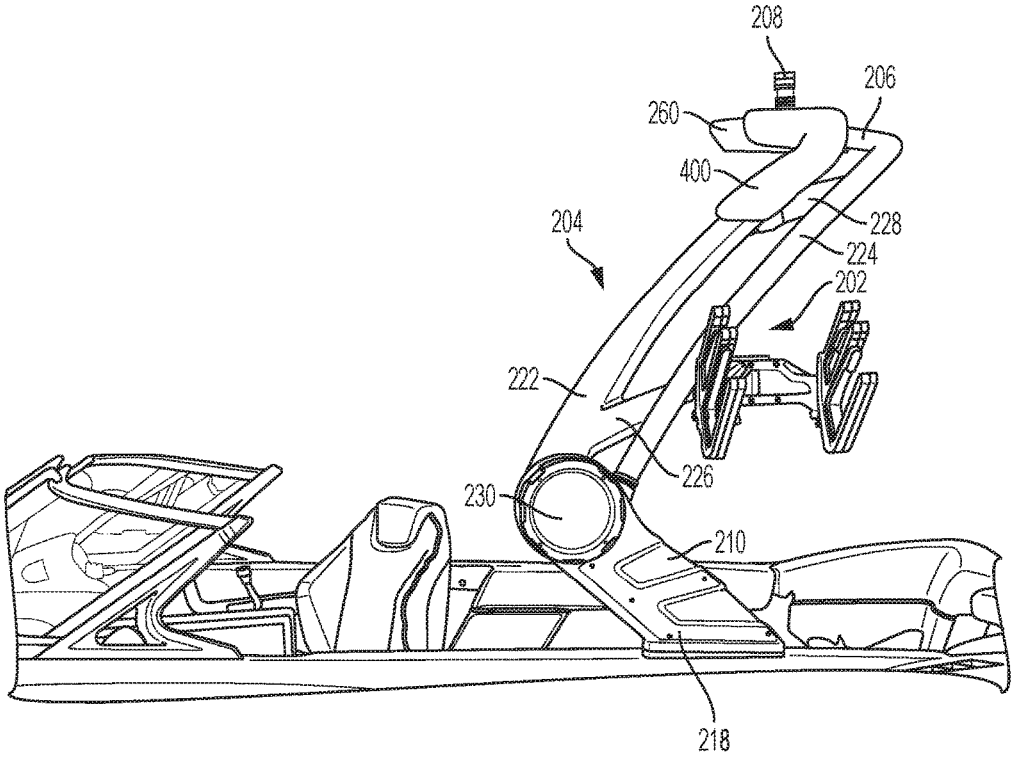
FIG. 11 is a perspective view of the towing apparatus shown in FIG. 9 with the bimini top in the stowed position.

The frame 410 of the bimini top 400 includes two support arms 412, one attached to the forward upper leg portion 222 of the port leg 202 and the other attached to the forward upper leg portion 222 of the starboard leg 204. The port and starboard sides of the bimini top 400 are mirror images of each other in this embodiment, but they may also have an asymmetric construction. The support arm 412 is pivotally attached to a lower portion of the forward upper leg portion 222 on the inboard side of the forward upper leg portion 222. The support arm 412 pivots about this attachment to move between the stowed position and the deployed position. As shown in FIG. 10, the support arm 412 will move in direction C to move from the deployed position to the stowed position and in the opposite direction to move from the stowed position to the deployed position.

Figure 9:
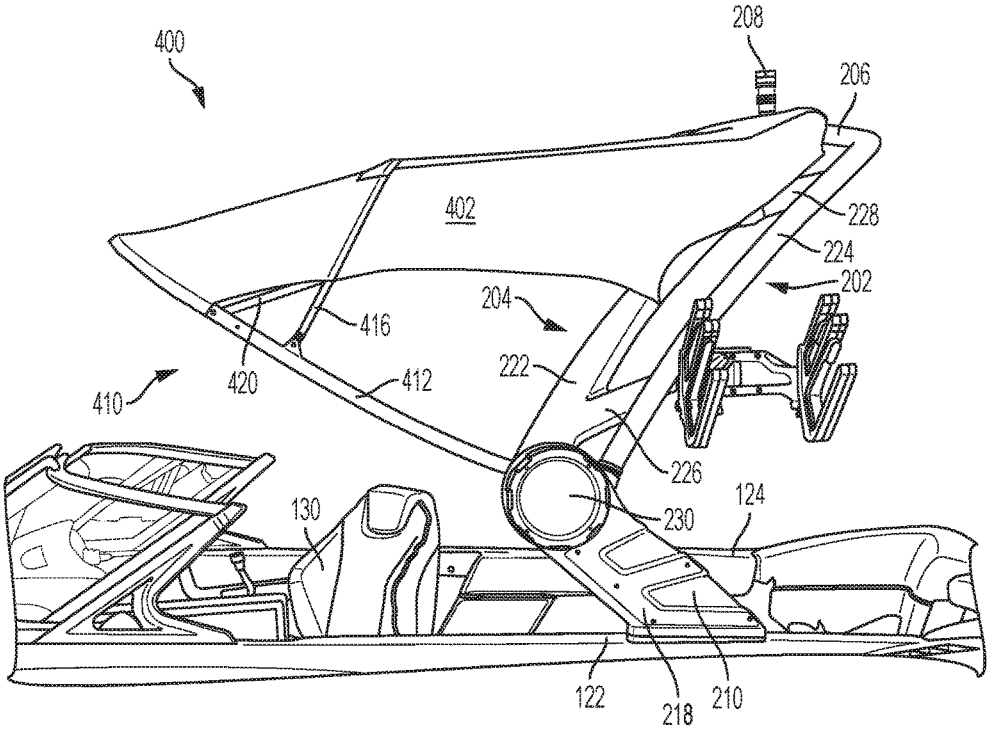
FIG. 9 is a perspective view of the towing apparatus shown in FIG. 1 with a bimini top in the deployed position.

As can be seen in FIG. 9, the support arm 412 is the prominent feature of the frame 410 that is visible when the bimini top 400 is in the deployed position. The support arm 412 of this embodiment complements the legs 202, 204 of the towing apparatus 200, and in particular, the forward upper leg portion 222. The support arm 412 is made from anodized aluminum billet, which may be dyed to match the color of the forward upper leg portion 222 if the forward upper leg portion 222 is dyed. The support arm 412 attached to the forward upper leg portion 222 of the port leg 202 has a profile, in the stowed position, that corresponds to the first profile of the forward upper leg portion 222. Likewise, the support arm 412 attached to the forward upper leg portion 222 of the starboard leg 204 has a profile, in the stowed position, that corresponds to the second profile of the forward upper leg portion 222. As discussed above, in this embodiment, the first profile and the second profile are the same and so are the profiles of the support arms 412. FIG. 12 is a perspective view of the inboard side of the starboard leg 204 showing the frame 410 in the stowed position. As shown, the profile of the support arm 412 corresponds to the profile of the forward upper leg portion 222 in that it does not extend outside of the profile of the forward upper leg portion 222. Put another way, it is hidden behind the forward upper leg portion 222 when viewed from the side at a position outside the boat 100 (see, e.g., the port leg 202 in FIG. 11). In particular, the support arm 412 is located near the forward edge of the forward upper leg portion 222 and the forward edge of the support arm 412 traces the sweeping curve of the forward upper leg portion 222.

The frame 410 also includes a forward hoop 414 and an intermediate hoop 416. One end of each hoop 414, 416 is connected to the support arm 412 connected to the port leg 202 and the other end is connected to the support arm 412 connected to the starboard leg 204. In the deployed position shown in FIG. 9, the cover 402 is stretched between the forward hoop 414 and the header 206, in particular, the forward tube of the first and second header portions 240, 250. The intermediate hoop 416 is used to support the cover 402 at an intermediate position between the forward hoop 414 and the header 206.

The frame 410 also includes a cross-arm 420. The cross-arm 420 is used to hold the support arm 412 in the deployed position. In particular, the cross-arm 420 prevents the support arm 412 from moving in direction C from the deployed position due to the tension in the cover 402. The cross-arm 420 is thus also used to maintain the cover 402 taut. The cross-arm 420 is pivotally attached to an upper portion of each leg 202, 204. As best seen in FIG. 12, the cross-arm 420 is attached to an inboard side of the upper bow tie 274.

The cross-arm 420 has two portions: a forward portion 422 and an aft portion 424. Each portion is about half the length of the cross-arm 420 and is constructed from stainless steel tube, although other suitable materials such as aluminum, for example, may be used. The forward portion 422 and the aft portion 424 are connected by a pivot 426. In this embodiment, the pivot 426 includes a hinge that can rotate 180 degrees although any suitable pivot 426 may be used. In the deployed position, the cross-arm 420 extends forward from the towing apparatus 200 and is pivotally connected to the support arm 412. To move from the deployed position to the stowed position, the pivot 426 and the aft cross-arm portion 424 move in direction D about the connection to the upper bow tie 274, and the forward cross-arm portion 422 moves in direction E about the connection to the support arm 412, thus allowing the support arm 412 to move in direction C. To move from the stowed position to the deployed position the cross-arm 420 moves in the opposite direction of directions D and E. The pivot 426 may also include a locking mechanism, such as a pin, for example, to keep the cross-arm 420 extended in the deployed position and prevent inadvertent movement toward the stowed position.

The cross-arm 420 may also be constructed to have a profile that corresponds to the first and second profiles of the forward upper leg portions 222. In this embodiment, the forward cross-arm portion 422 is straight, but the aft cross-arm portion 424 is curved such that in the stowed position, it does not extend outside of the profile of the forward upper leg portion 222 (see FIG. 12). Put another way, it is hidden behind the forward upper leg portion 222 when viewed from the side at a position outside the boat 100 (see, e.g., the port leg 202 in FIG. 11). The curve of the aft cross-arm portion 424 follows the sweeping curve of the aft edge of the upper leg portion 222 in this embodiment. An alternative construction of the cross-arm 420 is shown in FIG. 13. Here, instead of being straight, the forward cross-arm portion 422 is curved as well and has a profile that is complementary to the aft cross-arm portion 424.

Figure 14:
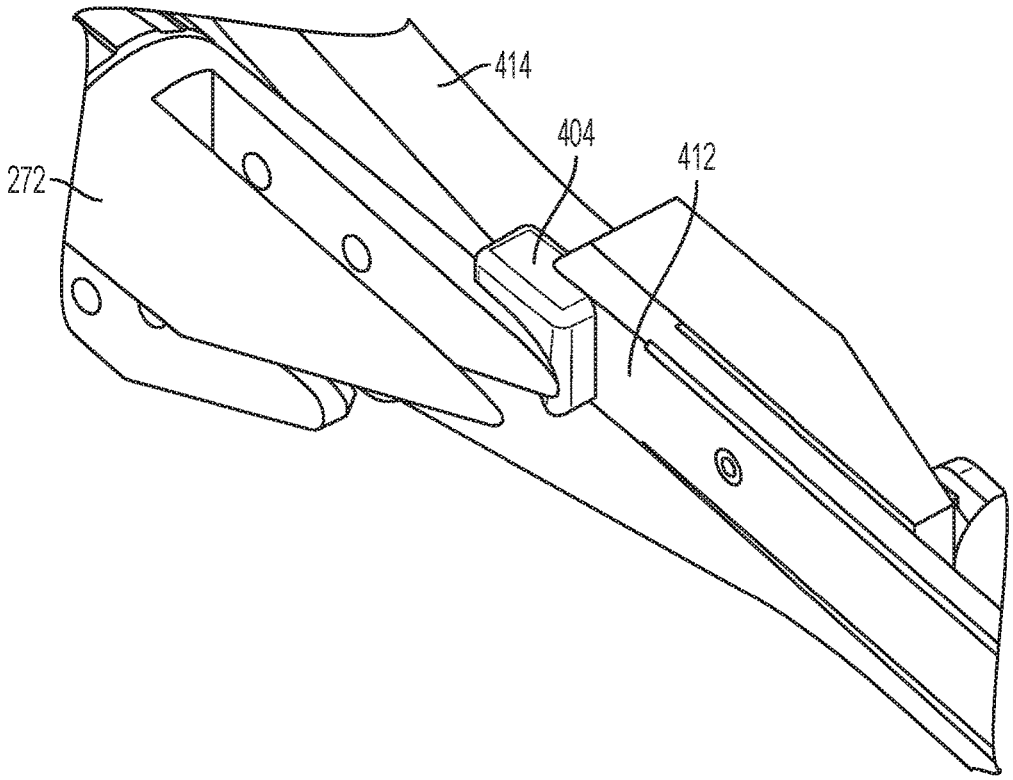
FIG. 14 is a detail view of the stopper of the frame of the bimini top in the stowed position.

In the stowed position, the frame 410 rests against the towing apparatus 200. Instead of resting directly against the towing apparatus 200, the frame 410 may optionally include a stopper 404. FIG. 14 is a detail view of the stopper 404 of the frame 410 in the stowed position. In particular, FIG. 14 shows upper tube receiver 272 of the starboard leg 204 and the support arm 412 in the stowed position. The forward upper leg portion 222 is not shown for clarity. The stopper 404 is located at the end of the support arm 412 that is opposite the end that is connected to the towing apparatus 200. As shown in FIG. 14, the stopper 404 contacts and rests against the upper tube receiver 272. A stopper 404 may be located on one or both support arms 412. Among other things, the stopper 404 is beneficial to prevent the dyed, anodized aluminum components from rubbing against each other and scratching the anodized surface. In this embodiment, the stopper 404 is polyoxymethylene (e.g., Delrin®), but any suitable material may be used.

Figure 15:
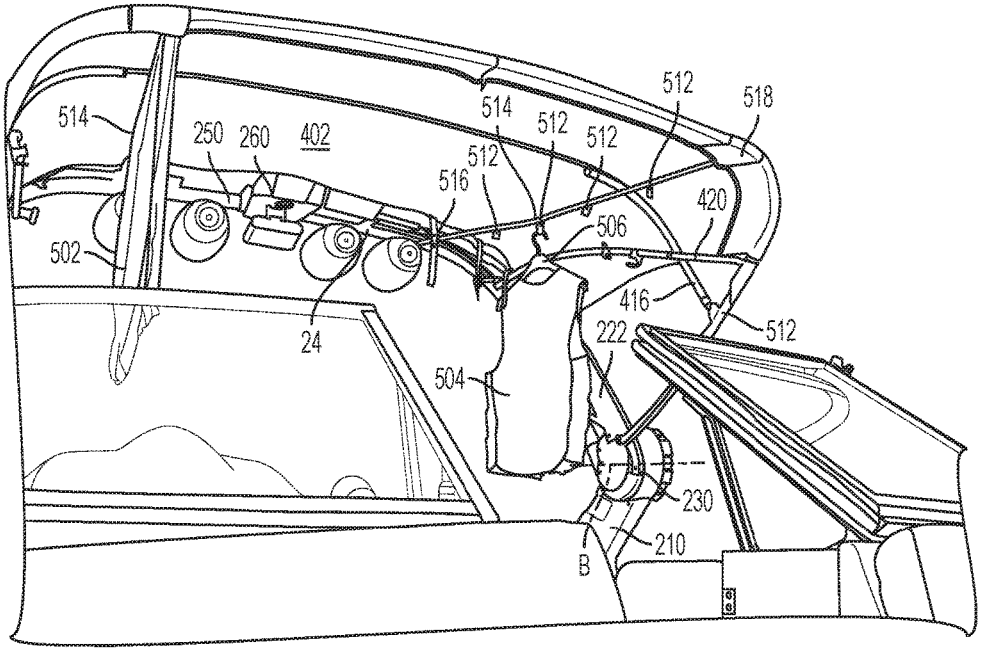
FIG. 15 is a perspective view of the towing apparatus shown in FIG. 9 showing the bimini top in the deployed position and hangers inside of the bimini top.

Another perspective view of the towing apparatus 200 and bimini top 400 is shown in FIG. 15. This view shows the underside of the bimini top 400. The bimini top 400 includes features for drying objects that may become wet during operation of the boat 100, such as towels 502, lifejackets 504, and the like. The drying features may include a plurality of drying hangers 512, which in this embodiment are drying loops. The drying loops are constructed of a weather-resistant durable material such as nylon webbing. A hook of a clothes hanger 506 or the like may be inserted into the loop of the drying hanger 512 to hang a life jacket 504, for example. The drying hangers 512 are not limited to fabric loops, however. Any suitable construction can be used, including for example, hooks, such as S-hooks, or rings, such as D-rings.

In this embodiment, the drying hangers 512 are connected to a line 514 that is suspended from the frame 410 and the towing apparatus 200. In this embodiment, the line 514 is a webbing, such as nylon webbing for example, and the drying hangers 512 are integrally formed in the line 514 by being sewn into the webbing. Two lines 514 are shown in FIG. 15, one on the port side connected to the first header portion 240 and the other on the starboard side connected to the second header portion 250. One end of the line 514 is attached to the forward hoop 414. The other end of the line 514 is wrapped around the forward tube of either the first or second header portion 240, 250, pulled tight, and secured with a buckle 516, although any suitable fastener or device may be used to secure the line 514. When not in use, the line 514 can be detached from the header 206 and stored in a pocket 518 formed in the bimini top 400 around the forward hoop 414. Even when the line 514 is not stored in the pocket 518, the line 514 may be collapsed with the cover 402 when the bimini top 400 is in the stowed position. In addition to using the hangers 512 for drying, the line 514 may also be used to dry objects. For example, a towel 502 may be thrown over the line 514 to dry.

Figure 16:
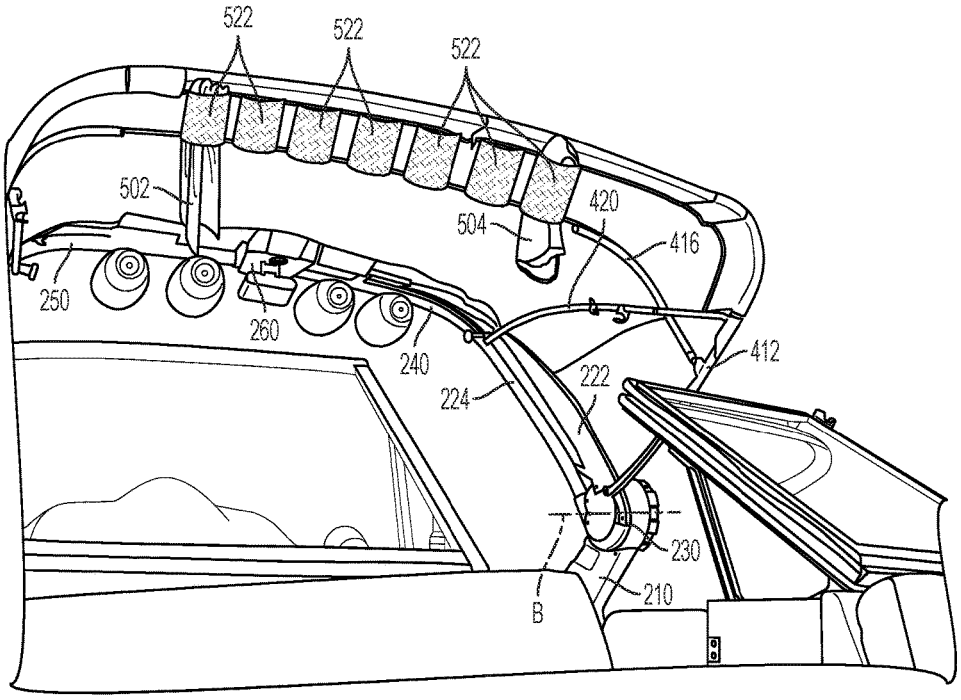
FIG. 16 is a perspective view of the towing apparatus shown in FIG. 9 showing the bimini top in the deployed position and alternate hangers inside of the bimini top.

The drying hangers 512 may be placed at any suitable location on the bimini top 400. Instead of the line 514 being suspended in a forward and aft direction as discussed above, the line 514 may be suspended from the frame 410 (such as the cross-arms 420) in a port and starboard direction. Likewise, instead of using the line 514, the drying hangers 512 may be integrally formed in the bimini top 400. The drying hangers 512 may be directly connected to the frame 410, such as the cross-arms 420, or sewn directly on the cover 402. FIG. 16 shows another embodiment of drying features on the bimini top 400. In this embodiment, the drying feature is a netting 522, such as bungee netting, suspended between the forward hoop 414 and the intermediate hoop 416.

While the foregoing discussion references certain materials, those skilled in the art will recognize that any material suitable for use in a marine environment and having other suitable characteristics for performing the functions discuss above (for example, strength and wear resistance) may be used in this invention.

The embodiments discussed herein are examples of preferred embodiments of the present invention and are provided for illustrative purposes only. They are not intended to limit the scope of the invention. Although specific configurations, structures, materials, etc. have been shown and described, such are not limiting. Modifications and variations are contemplated within the scope of the invention, which is to be limited only by the scope of the issued claims.

What is claimed is:

1. A towing apparatus for towing a water sports performer, the towing apparatus comprising:

a first leg adapted for attachment to one of a port side of a centerline of a boat or a starboard side of a centerline of a boat;

a second leg adapted for attachment to an opposite one of the port side of a centerline of a boat or the starboard side of a centerline of a boat;

a header capable of having a plurality of different header lengths, the header including:

a first header portion, the first header portion including a first end connected to the first leg and a second end;

a second header portion, the second header portion including a first end connected to the second leg and a second end;

a housing connecting the first header portion and the second header portion, the housing including a first receiver configured to receive the second end of the first header portion at a plurality of different positions; and a first locking mechanism configured to secure the second end of the first header portion to the housing in one of the plurality of different positions to set a length of the header; and a tow-line-attachment structure provided on the header.

2. The towing apparatus of claim 1, wherein:

the housing includes a second receiver configured to receive the second end of the second header portion at a plurality of different positions; and the header includes a second locking mechanism configured to secure the second end of the second header portion to the housing in one of the plurality of different positions to set the header length.

3. The towing apparatus of claim 1, wherein the locking mechanism comprises:

a plurality of grooves on the second end of the first header portion; and a clasp including a tongue configured to engage with each of the plurality of grooves, the clasp being configured to be secured to the housing.

4. The towing apparatus of claim 3, wherein the tongue of the clasp is engaged with one of the plurality of grooves and the clasp is secured to the housing to secure the second end of the first header portion to the housing in one of the plurality of different positions.

5. The towing apparatus of claim 3, wherein the clasp further includes a first side and a second side opposed to the first side, the tongue being positioned (1) between the first side and the second side and (2) closer to the first side than the second side.

6. The towing apparatus of claim 1, wherein the locking mechanism comprises a clamp.

7. The towing apparatus of claim 1, wherein the locking mechanism comprises:

a plurality of holes in the second end of the first header portion; and a pin configured to engage with each of the plurality of holes.

8. The towing apparatus of claim 7, wherein the pin is engaged with one of the plurality of holes to secure the second end of the first header portion to the housing in one of the plurality of different positions.

9. The towing apparatus of claim 8, wherein the first receiver includes a hole and the pin is engaged with the whole of the first receiver.

10. The towing apparatus of claim 1, further comprising:

a spacer configured to engage with the second end of the first header portion; and a nut, wherein the second end of the first header portion includes a male thread configured to engage with the nut, the locking mechanism comprising the male threads and the nut, and wherein the spacer is secured between the housing and the second end of the first header portion to secure the second end of the first header portion to the housing in one of the plurality of different positions.

11. The towing apparatus of claim 1, further comprising:

a first nut; and a second nut, wherein the second end of the first header portion includes a male thread configured to engage with the first and second nuts, the locking mechanism comprising the male threads, the first nut, and the second nut.

12. The towing apparatus of claim 1, wherein the locking mechanism comprises a self-tapping screw to secure the second end of the first header portion to the housing in one of the plurality of different positions.

13. The towing apparatus of claim 1, wherein the first leg is adapted for attachment to one of a port side or a starboard side of the hull, and the second leg is adapted for attachment to the other one of the port side or the starboard side of the hull.

14. The towing apparatus of claim 1, wherein the first leg is adapted for attachment to one of a port gunwale or a starboard gunwale, and the second leg is adapted for attachment to the other one of the port gunwale or the starboard gunwale.

15. A towing apparatus for towing a water sports performer, the towing apparatus comprising:

a first leg adapted for attachment to one of a port side of a centerline of a boat or a starboard side of a centerline of a boat;

a second leg adapted for attachment to an opposite one of the port side of a centerline of a boat or the starboard side of a centerline of a boat;

a header capable of having a plurality of header lengths, the header including:

a first header portion comprising two tubes each including a first end and a second end, the first end of each tube connected to the first leg;

a second header portion comprising two tubes each including a first end and a second end, the first end of each tube connected to the second leg;

a housing connecting the first header portion and the second header portion, the housing including at least four receivers configured to accept the second end of each of the parallel tubes of the first and second header portions at a plurality of different positions; and a plurality of locking mechanisms, each locking mechanism corresponding to each tube and configured to secure the tubes to the housing in one of the plurality of different positions to set a length of the header; and a tow-line-attachment structure provided on the header.

16. The towing apparatus of claim 15, wherein each locking mechanism comprises:

a plurality of grooves on the second end of each of the tubes; and a clasp including a tongue configured to engage with each of the plurality of grooves, the clasp being configured to be secured to the housing.

17. The towing apparatus of claim 16, wherein, in each locking mechanism, the tongue of the clasp is engaged with one of the plurality of grooves and the clasp is secured to the housing to secure the respective tube to the housing in one of the plurality of different positions.

18. The towing apparatus of claim 15, wherein each locking mechanism comprises a clamp.

19. The towing apparatus of claim 15, wherein each locking mechanism comprises:

a plurality of holes on the second end of each tube; and a pin configured to engage with each of the plurality of holes.

20. The towing apparatus of claim 19, wherein, in each locking mechanism, the pin is engaged with one of the plurality of holes to secure the respective tube to the housing in one of the plurality of different positions.

* * * * *